United States Patent [19]

Zysset

[11] 4,455,114

[45] Jun. 19, 1984

[54] METHOD FOR MAKING A METALLIC-CONVENIENCE CLOSURE

[75] Inventor: Edgar H. Zysset, Orlando, Fla.

[73] Assignee: General Can Company, Inc., City of Industry, Calif.

[21] Appl. No.: 372,042

[22] Filed: Apr. 26, 1982

Related U.S. Application Data

[63] Continuation-in-part of Ser. No. 301,554, Sep. 14, 1981, Pat. No. 4,394,927.

[51] Int. Cl.[3] ..... B21D 51/00

[52] U.S. Cl. ..... 413/14; 413/66; 413/67

[58] Field of Search ..... 413/12, 14–17, 413/66, 67; 29/509, 522 R, 522 A; 220/269, 270, 272, 273

[56] References Cited

U.S. PATENT DOCUMENTS

| | | | |
|---|---|---|---|
| 3,696,961 | 10/1972 | Holk, Jr. | 220/269 |
| 3,765,352 | 10/1973 | Schubert et al. | 413/14 |
| 3,819,083 | 6/1974 | Holk, Jr. | 220/270 |
| 3,820,681 | 6/1974 | Hulsen | 413/12 |
| 3,939,787 | 2/1976 | Morrison et al. | 413/14 |
| 3,990,376 | 11/1976 | Schubert | 413/13 |
| 3,993,010 | 11/1976 | Taniuchi | 413/13 |
| 4,052,949 | 10/1977 | Woodley | 413/14 |
| 4,108,331 | 8/1978 | Khoury | 220/273 |
| 4,211,335 | 7/1980 | Langseden | 220/269 |
| 4,322,016 | 3/1982 | Barrash | 220/270 |

*Primary Examiner*—Leon Gilden

*Attorney, Agent, or Firm*—Barnes, Kisselle, Raisch, Choate, Whittemore & Hulbert

[57] ABSTRACT

A method and apparatus for making metallic-convenience closure for a cylindrical container by forming a panel with an endless severing line formed in the panel and defining a central removable portion and a peripheral fixed portion adapted for attaching a closure to the end of a container to close the end and attaching manually graspable pull-tab is attached to the removable portion of the panel, the pull-tab having a nose portion movable upon lifting of the tab into position adjacent the score line for severing the score line. The tab includes a first portion which is attached by a rivet to the removable portion of the panel, a second portion extending radially outwardly toward the score line, and a manual graspable portion integral with the second portion and extending radially inwardly. After the pull-tab is attached to the closure with the second portion of the pull-tab extending radially outwardly toward the score line of the panel, opposed clamping forces are applied to the exposed surface of the manual graspable portion, and the portion of the pull-tab attached to the removable portion of the panel, and a force is applied to the portion of the panel surrounded by the graspable portion of the pull-tab to deform the portion upwardly into the area surrounded by the graspable portion so that the deformed portion prevents rotation about the axis of the rivet.

2 Claims, 13 Drawing Figures

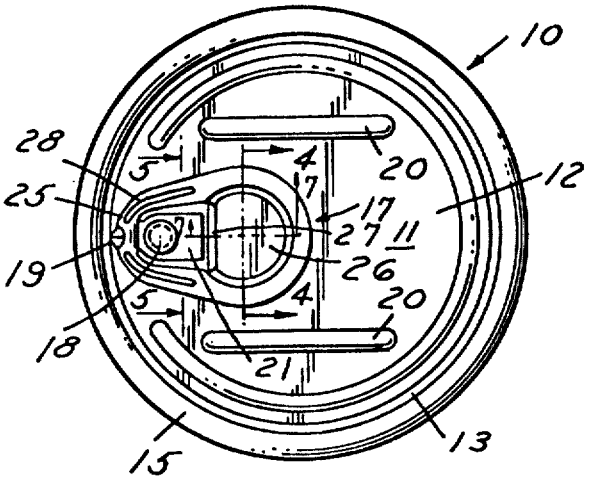
FIG. 1
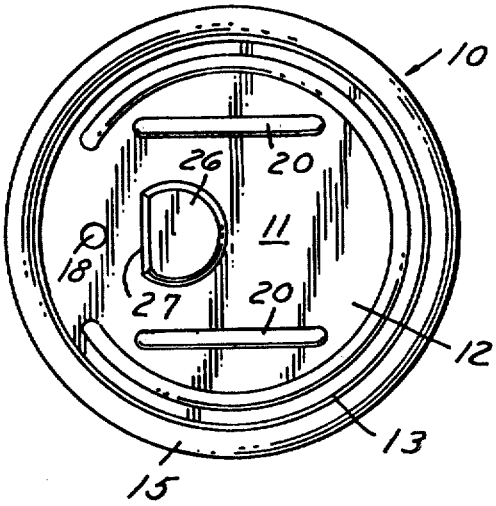
FIG. 2
FIG. 6
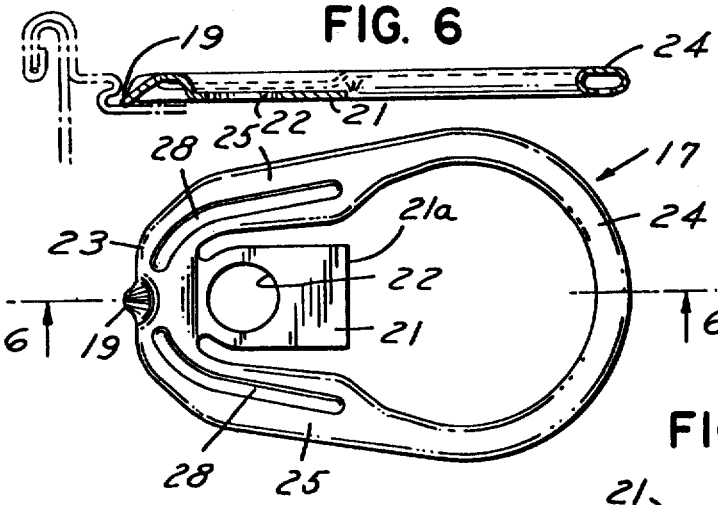
FIG. 3
FIG. 7
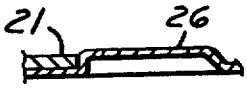
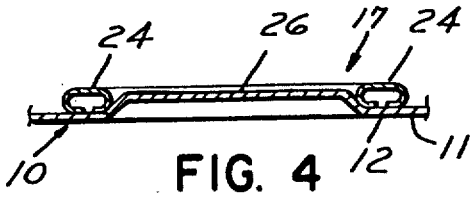
FIG. 4
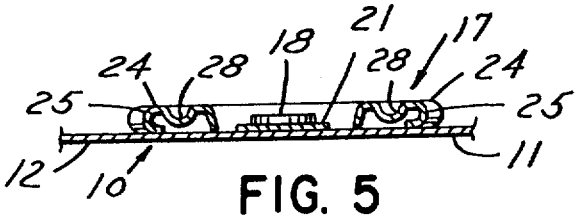
FIG. 5

METHOD FOR MAKING A METALLIC-CONVENIENCE CLOSURE

This application is a continuation-in-part of application Ser. No. 301,554 filed Sept. 14, 1981, now U.S. Pat. No. 4,394,929.

This invention relates to metallic-convenience closures for cylindrical containers.

BACKGROUND AND SUMMARY OF THE INVENTION

A common type of metallic-convenience closure comprises a panel with an endless score line forming a central removable portion and a peripheral fixed portion that is attached to the cylindrical container. A pull-tab having a nose portion is fastened to the removable portion by a rivet so that when the pull-tab is manually grasped, the nose portion of the pull-tab moves into position adjacent the score line severing the panel. Further movement of the pull-tab completes the severing to remove the removable portion. Typical patents showing such construction are U.S. Pat. Nos. 3,696,961, 3,705,563, 3,819,083 and 3,986,632.

One of the problems with respect to convenience closures is that there is a tendency for the pull-tab to rotate about the rivet axis either during handling of the container or during opening. If the pull-tab rotates more than a predetermined amount, then it is difficult if not impossible to open the convenience closure since the nose portion of the tab will not be close enough to the score line to cause a severing thereof.

Accordingly, among the objectives of the present invention are to provide a metallic convenience closure which will prevent rotation of the pull-tab and thereby insure registration of the nose portion of the pull-tab with the score line. Among the objectives of the present invention are to provide a novel method and apparatus for making the metallic-convenience closure.

In accordance with the invention, a portion of the removable portion of the panel of the closure is deformed adjacent a portion of the tab that is riveted to the removable portion to prevent rotation of the tab and maintain registry of the nose portion of the tab with the score line. After the pull-tab is attached to the closure with the second portion of the pull-tab extending radially outwardly toward the score line of the panel, opposed clamping forces are applied to the exposed surface of the manual graspable portion, and the portion of the pull-tab attached to the removable portion of the panel, and a force is applied to the portion of the panel surrounded by the graspable portion of the pull-tab to deform the portion upwardly into the area surrounded by the graspable portion so that the deformed portion prevents rotation about the axis of the rivet.

DESCRIPTION OF THE DRAWINGS

FIG. 1 is a plan view of a convenience closure embodying the invention.

FIG. 2 is a plan view of the closure with the manually graspable pull-tab removed.

FIG. 3 is a plan view on an enlarged scale of the pull-tab.

FIG. 4 is a fragmentary sectional view on an enlarged scale taken along the line 4—4 in FIG. 1.

FIG. 5 is a fragmentary sectional view on an enlarged scale taken along the line 5—5 in FIG. 1.

FIG. 6 is a sectional view on an enlarged scale taken along the line 6—6 in FIG. 3.

FIG. 7 is a fragmentary view taken along the line 7—7 in FIG. 1.

DESCRIPTION

Figure 8:
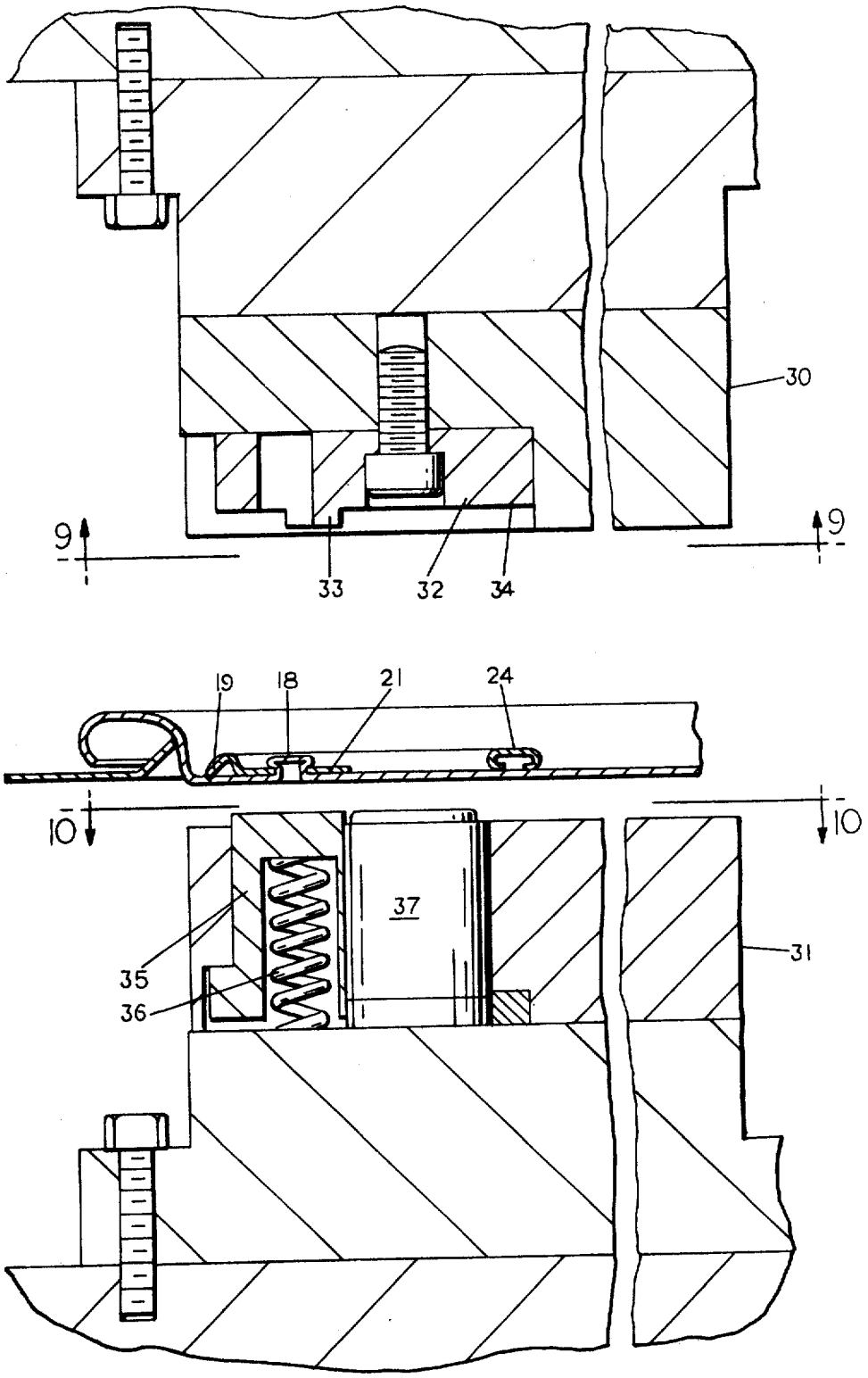
FIG. 8 is an exploded vertical sectional view of an apparatus embodying the invention.
Figure 9:
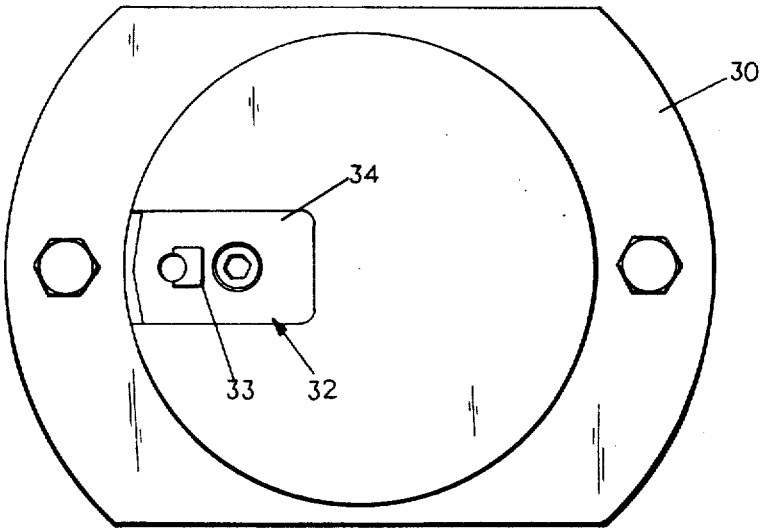
FIG. 9 is a view taken along the line 9—9 in FIG. 8.
Figure 10:
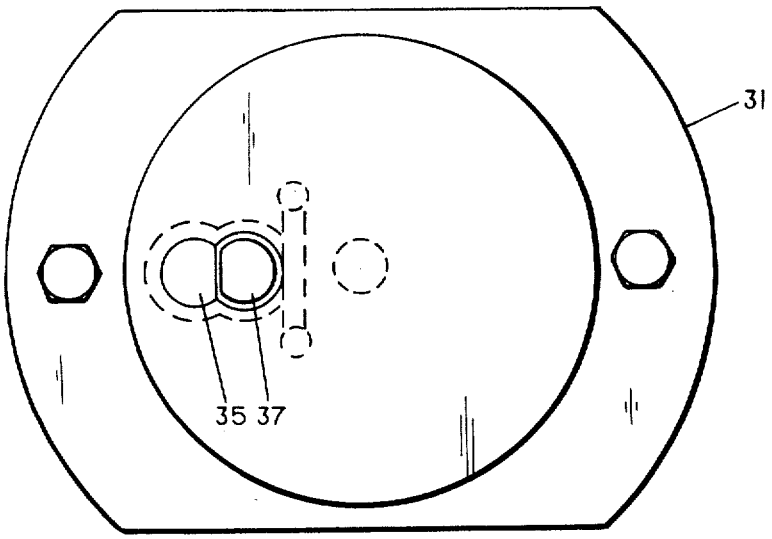
FIG. 10 is a view taken along the line 10—10 in FIG. 8.
Figure 11:
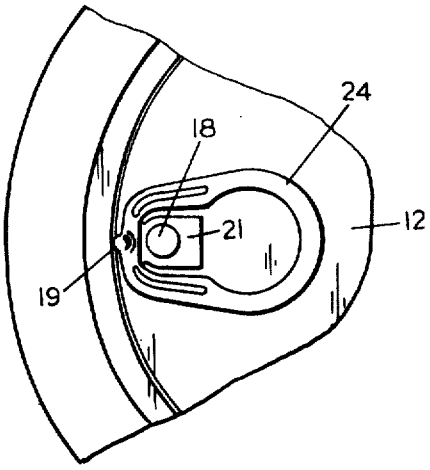
FIG. 11 is a fragmentary plan view of a partially formed closure.

Referring to FIGS. 1-3, the convenience container includes a metallic closure 10 embodying the invention comprises a metallic panel 11 with a central removable portion 12 defined by an endless score line 13, a peripheral fixed portion comprising an integral safety bead 14 overlying the score line 13, and an annular channel portion 15 whereby the closure can be double seamed to the top of a cylindrical container 16 to close the end of the container 16 (FIG. 6). The convenience closure includes a pull-tab 17 extending generally radially and fastened to the removable panel portion by a rivet 18. The pull-tab 17 includes a nose portion 19 that is movable adjacent the score line 13 when the pull-tab 17 is lifted by hand causing the severing of the panel at the score line 13. Further pulling of the tab 17 completes the severing and removal of the panel. This general construction is disclosed in the aforementioned United States patents which are incorporated herein by reference. Stiffening means in the form of parallel integral beads 20 formed upwardly from the plane of the removable panel are provided and extend generally parallel to the opening direction, that is, parallel to the longitudinal axis of the pull-tab 17 on the removable portion 12 of the panel 11. The construction of the beads is the subject matter of a copending U.S. application Ser. No. 280,577, filed July 6, 1981, having a common assignee with the present invention.

In accordance with the invention, the pull-tab 17 includes a first generally rectangular portion 21 having an opening 22 therein through which the integral rivet portion 18 of the removable panel 12 extends and is thereafter flattenned to fasten the pull-tab 17 to the removable portion of the panel. The pull-tab further includes a second portion 23 extending radially outwardly and defining the nose portion 19 which is positioned adjacent the score line 13 for initiating severing. The pull-tab 17 further includes a manually graspable portion 24 in the form of a ring extending rearwardly by connecting arms 25 generally parallel to the first portion 21. Removable panel 12 is formed with an embossed area 26 of panel which is embossed upwardly and includes a straight edge portion 27 completely to the straight end edge **21*a* of portion 21 of the tab 17 to prevent rotation of the tab 17. Portion 27 preferably comprises an inclined or slanted portion formed by embossing and extending upwardly and inwardly away from the periphery of the closure 10**.

As a result, registration of the nose 19 with the scoreline 13 is insured. During opening of the convenience closure or during storage, pivoting or rotation of the pull-tab 17 to a position wherein the nose 19 is out of registry with the score line 13 is prevented.

The embossed area 26 preferably extends to the inner periphery of the ring portion 24 of the pull-tab 17. In addition, the second portion 23 manually graspable portion 24 and arms 24 are formed so that they are curled in cross section as shown in FIGS. 4 and 5 stiffen them. In addition, stiffening grooves 28 are provided along arms 25 and extend into portion 23 curving inwardly toward the nose. The pull-tab 17 is preferably made by moving a strip S of metal progressively by stamping.

In accordance with the invention, the metallic-convenience closure is made after the pull-tab is attached to the closure with the second portion of the pull-tab extending radially outwardly toward the score line of the panel, opposed clamping forces are applied to the exposed surface of the manual graspable portion, and the portion of the pull-tab attached to the removable portion of the panel, and a force is applied to the portion of the panel surrounded by the graspable portion of the pull-tab to deform the portion upwardly into the area surrounded by the graspable portion so that the deformed portion prevents rotation about the axis of the rivet.

Referring to FIG. 8, the apparatus embodying the invention comprises an upper die 30 and a lower die 31. After the panel has been formed and the pull-tab has been formed, they are first assembled by attachment through the integral rivet 18 so that the nose portion 19 extends toward the score line 13.

As shown in FIG. 8, the upper die 30 includes a die piece 32 that has a downwardly extending portion 33 that is adapted to engage the rectangular portion 21 of the pull-tab and a second portion 34 adapted to contact the upper exposed surface of the manually graspable portion 24. The lower die 31 includes a spring-loaded die portion 35 adapted to apply an opposing clamping force to the panel beneath the rectangular portion 21, rivet portion 18, and nose portion 19. Die portion 35 is yieldingly urged upwardly by a spring 36. The lower die 31 further includes a fixed die portion 37 that is D-shaped and is adapted to apply an upward deforming force to the area of the panel that is surrounded by the ring or gripping portion 24. Thus the manually graspable portion is used as a die.

Figure 12:
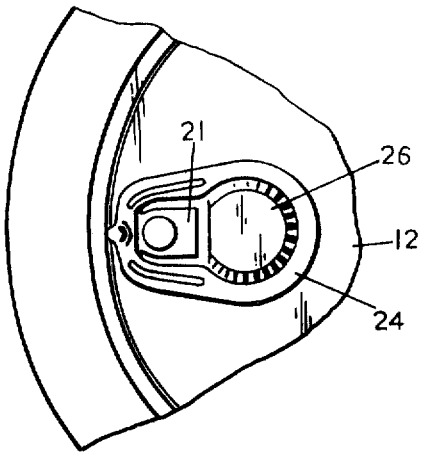
FIG. 12 is a fragmentary sectional view similar to FIG. 6 showing the parts in a different operative position.
Figure 13:
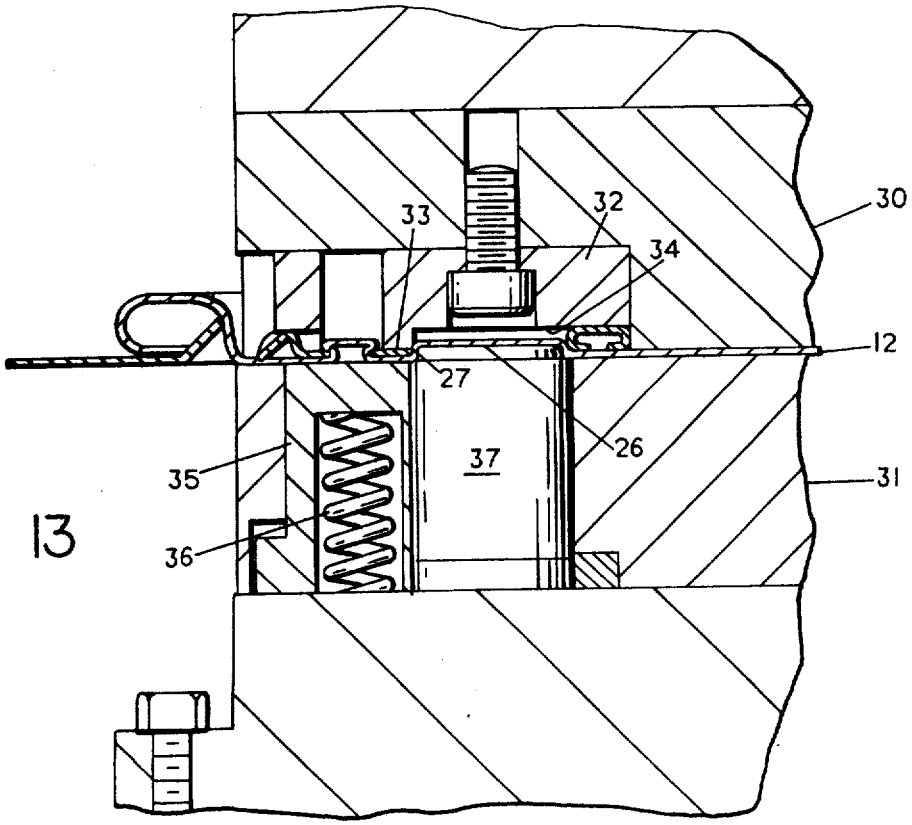
FIG. 13 is a fragmentary plan view of the closure after it has been formed.

In accordance with the invention, the closure with the pull-tab attached is placed between the dies 30, 31 and the dies are moved toward one another, first clamping the rectangular portion 21, and then the continued closing of the dies deforms the portion of the panel upwardly into the ring 24, the free edge 21*a* and the inner edge of the ring 24 cooperating to produce the desired configuration of the deformed portion 26 including the straight edge 27 (FIGS. 12, 13).

I claim:

1. In the method of manufacture of a metallic-convenience closure for a cylindrical container comprising a panel, an endless severing line formed in the panel and defining a central removable portion and a peripheral fixed portion, means forming a part of the fixed portion for attaching a closure to the end of a container to close the end, and a manually graspable pull-tab attached to the removable portion of the panel and having a nose portion movable upon lifting of the tab into position adjacent the score line for severing the score line, said tab including a first portion riveted to said removable portion of the panel, a second portion extending radially outwardly toward the score line and terminating in said nose portion, and a manual grasping portion integral with the second portion and extending radially inwardly, said removable portion of the panel having a portion thereof deformed adjacent the first portion of the tab preventing rotation of the tab about the axis of the rivet thereby maintaining registry of the nose portion of the score line during the opening of the convenience closure, which method comprises the steps of, attaching the pull-tab to the closure with the second portion of the pull-tab extending radially outwardly toward the score line of the panel, applying a clamping force to the first portion of the manual graspable portion, applying an opposing yielding clamping force to the first portion of the pull-tab attached to the removable portion of the panel, applying an opposing force to the portion of the panel surrounded by the graspable portion of the pull-tab to deform the portion upwardly into the area surrounded by the graspable portion.

2. The method set forth is claim 1 including the step of applying a restraining force to the exposed surface of the manually graspable portion of the pull-tab.

* * * * *